United States Patent [19]

Culling

[11] Patent Number: 4,765,957

[45] Date of Patent: Aug. 23, 1988

[54] ALLOY RESISTANT TO SEAWATER AND OTHER CORROSIVE FLUIDS

[75] Inventor: John H. Culling, St. Louis, Mo.

[73] Assignee: Carondelet Foundry Company, St. Louis, Mo.

[21] Appl. No.: 947,095

[22] Filed: Dec. 29, 1986

[51] Int. Cl.[4] ..... C22C 30/02

[52] U.S. Cl. ..... 420/582; 420/584; 420/585; 420/586

[58] Field of Search ..... 420/45, 46, 47, 584, 420/582, 585, 586

[56] References Cited

FOREIGN PATENT DOCUMENTS 57-16153 1/1982 Japan ..... 420/45

1142582 2/1969 United Kingdom ..... 420/45

*Primary Examiner*—Deborah Yee

*Attorney, Agent, or Firm*—Senniger, Powers, Leavitt and Roedel

[57] ABSTRACT

The alloys of this invention are of low strategic element content, nonmagnetic, resistant to damage by chloride- or other halide-containing solutions as well as to a wide variety of other chemical agents, airmeltable, castable, of improved fabricability and weldability and of higher chromium level but lower molybdenum contents than other alloys intended for chloride resistance. The alloys consist by weight percentages of from about 13.5% to about 29% Ni, from about 23 to about 26% Cr, from about 3.75 to about 6% Mo, from about 2.95 to about 4.5% Mn, from about 3 to about 6.39% Cu, from about 0.3 to about 2.07% Cb (Nb), from about 0 to about 1.5% Si, from about 0 to about 0.09% C, from about 0.10% to about 0.45% N, up to about 1% V, up to about 1% Ti, up to about 5% Co, as a partial substitute for Ni, up to about 0.3% Ce, La or Misch metal, and the balance essentially iron. The sum of the Ni and Co content is between about 18.5% and about 29% by weight.

5 Claims, 1 Drawing Sheet

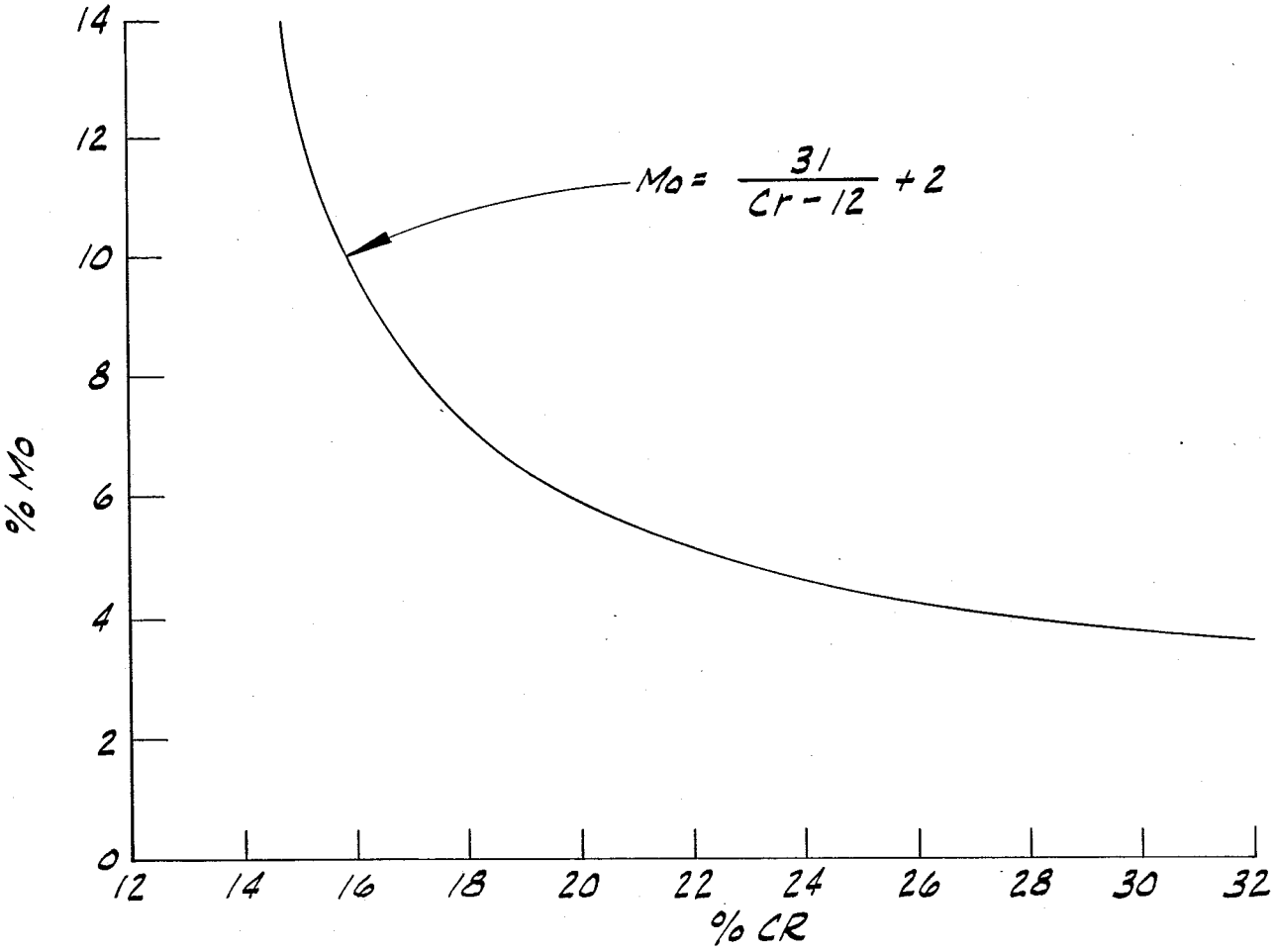
$Mo = \frac{31}{Cr-12} + 2$
% Mo
0
2
4
6
8
10
12
14
% CR
12
14
16
18
20
22
24
26
28
30
32

ALLOY RESISTANT TO SEAWATER AND OTHER CORROSIVE FLUIDS

BACKGROUND OF THE INVENTION

There is great demand for materials resistant to sea water, brackish water or other solutions that contain chlorides or other halide ions. Examples are equipment for surface vessels and submarines and for various chemical handling and power plant applications.

At the present time the two most important known elements that confer chloride resistance to iron-base or nickel-base alloys are molybdenum and chromium.

For maritime applicaton, an alloy has been considered generally satisfactory if it resists corrosion by seawater at ambient temperatures. Recently, however, the extensive use of seawater or brackish water as a cooling medium in heat exchangers has increased, with the result that there is great demand for materials that resist damage by both seawater and the process fluids that are being cooled. In some cases, the process fluid is highly corrosive to many materials, even to some that are able to resist seawater attack. Much progress has been made in developing materials with the required corrosion resistance and other properties. However, such materials have tended to be quite expensive, high in critical or strategic element content, and difficult to prepare and fabricate. Thus, there is great interest in the development of lower cost alloys that are more effective or more efficient than those presently in service in resisting attack by seawater and process fluids.

There is also the desirability in some applications that such alloys be substantially nonmagnetic. One such application is for naval mine-sweepers which must avoid destruction by magnetic mines. Nonmagnetic alloys are also advantageous materials of construction for submarines, since they allow the vessel to elude the magnetic anomaly detector systems that are employed to locate submerged submarines. These systems sense changes in the earth's magnetic field caused by metallic masses as large as steel submarines.

The element titanium and its principal alloys are nonmagnetic, are totally immune to ordinary seawater attack, and have been employed in the hulls of a few submarines and in the heat exchanger tubes of a few seawater-cooled power plants. However, titanium is relatively scarce and expensive, quite difficult to fabricate, and very susceptible to contamination and embrittlement if processed by conventional methods. Hence, Ti weldments tend to crack and leak, and Ti cannot be melted and cast into shapes except under the most rigorous conditions in vacuum or inert gas atmospheres. Also, use of titanium tubing in retrofitting existing heat exchangers may lead to excessive vibration failures unless dampeners are used or support sheets are repositioned.

Thus, there is continued interest in air meltable, castable, weldable, fabricable alloys to resist attack by sea water, and for many applications that remain essentially non-magnetic.

In spite of their excellent overall corrosion resistance, the usual commercial stainless steels are subject to localized corrosion in stagnant seawater. Stagnant conditions arise when the flow rate over the metallic surfaces is less than about 1.2 to 1.6 meters per second (3.9 to 5.2 feet per second), when marine organisms are attached to the surfaces, or where crevices exist. Such conditions are very difficult to avoid completely in actual practice.

Thus, although general corrosion of stainless steel components tends to be very low in seawater, very serious damage leading to early failure often occurs because of localized corrosion.

Pitting attack and penetration or perforation of stainless steels tend to take place on broad surfaces with low fluid flow rates, while some form of crevice corrosion takes place where there are imperfect contacts with mud, fouling substances, wood, paint, or other bodies, or even where there are reentrant angles or corners.

A major obstacle to the use of austenitic stainless steels for service in strong chloride environments has been the possibility of chloride stress corrosion cracking. Under conditions of even moderate stress and temperature, type 304 (ordinary 18% Cr 8% Ni) stainless steel will crack at very low chloride levels. Stress corrosion cracking has not really been well understood in the past, but it is now known that improved and highly modified stainless steels of higher molybdenum contents above 3.5% have a degree of resistance to chloride stress corrosion cracking that is more than adequate for most high chloride service.

Ferritic iron-chromium-molybdenum stainless steels have been developed for chloride service, but they must be produced with extrememly low carbon and nitrogen contents, and are hence not available as cast shapes by ordinary production methods. They are also magnetic and readily attacked by many common chemicals.

A number of austenitic, nonmagnetic, nickel-base alloys have also been developed for the same types of service. These have contained up to 31% Cr, up to 28% Mo, and from about 45% to about 65% Ni. They often contain 1 to 4% W and up to 4% Cb (Nb) plus Ta, iron being limited to levels around 2 to 6% maximum. The combined proportion of Mo, Cr and W in these alloys varies between about 32 and 42% total. Such high levels of the latter elements require very high nickel and low iron contents in order to maintain a single-phase austenitic (face-centered-cubic) crystal structure. While these nickel-base alloys are castable, weldable, and fairly fabricable, they must be produced from high-purity, extremely expensive and relatively scarce melting stock.

My copending application, Ser. No. 947,427, filed Dec. 29, 1986 describes an iron-base alloy of approximately 18% Cr, 7.5% Mo and certain other elements. This alloy is suitable for use in seawater and is also resistant to many corrosive process fluids. As a consequence, it is useful not only in numerous marine applications, but also in process heat exchangers in which other corrosive fluids are cooled with seawater. However, while the alloy of my copending application has been shown to resist various chemical solutions in the presence of or including chlorides or sea water, it remains desirable to provide the same chloride-resistance with lower Mo content. Commercial alloys for chloride service may contain from 17% to 21% Cr and usually over 5 or 6% Mo. All of these resist various corrosive substances in addition to sea water. However, other corrosive substances readily attack such alloys. For example, process streams generated in the production and handling of phosphoric acid are quite corrosive to equipment constructed of such alloys. Another case is equipment for handling many concentrations of pure or impure sulfuric acid. Another very important case is alloys used in off-shore wells for the recovery of "sour" gas and oil as found in the Mid-East oil fields and elsewhere. "Sour" means that the fluids are high in hydrogen sulfide and mercaptan contents. In addition to sulfur compounds, deep sour wells also encounter carbon dioxide, salts such as brine, and temperatures up to 300° to 500° F. (150° to 260° C.). These are all examples of severe service conditions in which chloride resistance of my prior alloy or of the usual commercial chloride-resistant alloys may not be adequate.

SUMMARY OF THE INVENTION

Among the several objects of the present invention, therefore, may be noted the provision of improved alloys resistant to chlorides as well as other corrosive streams; the provision of such alloys which are resistant to process streams of corrosive fluids such as may be encountered in heat exchangers and process equipment used in the manufacture or handling of contaminated phosphoric acid, various concentrations of hot sulfuric acid, and deep sour well fluids; the provision of such alloys which may be economically formulated with relatively low proportions of strategic metals such as nickel, chromium and molybdenum; the provision of such alloys whose strategic metal content is sufficiently low so that they may be formulated from such relatively low-cost raw materials as scraps, ferro alloys or other commercial melting alloys; the provision of such alloys which can be cast or wrought; the provision of such alloys which have a low hardness and high ductility so that they may be readily rolled, forged, welded and machined; the provision of such alloys which are air-meltable and air-castable; the provision of such alloys which are substantially nonmagnetic, i.e., for military and naval applications such as minesweepers and submarines; the provision of such alloys that do not require heat treatment after welding or hot working to avoid intergranular attack; the provision of such alloys which resist pitting attack, crevice corrosion and stress corrosion cracking failures; and the provision of such alloys which are resistant to localized attack in stagnant seawater.

Briefly, therefore, the present invention is directed to an air-meltable, castable, workable, non-magnetic alloy resistant to corrosion by chloride-containing solutions. The alloy consists essentially of between about 13.5% and about 29% Ni, from about 23% to about 26% Cr, from about 3.75% to about 6% Mo, from about 3% to about 4.5% Mn, from about 3% to about 6.39% Cu, from about 0.10% to 0.45% N, from about 0.3% to about 2.07% Cb, up to about 1.5% Si, up to about 0.09% C, up to about 1% Ti, up to about 5% Co as a partial substitute for Ni, and up to about 0.3% Ce, La or misch metal. All of the above percentages are by weight. The sum of the Ni content and Co content is between about 18.5% and about 29% by weight.

BRIEF DESCRIPTION OF THE DRAWING

The single FIGURE of the drawing is a plot of an algorithm useful in formulating alloys resistant to chloride stress corrosion cracking.

DESCRIPTION OF THE PREFERRED EMBODIMENT

In accordance with the present invention, alloys are provided which are virtually immune to chloride or sea water depassivation and are at the same time very highly resistant to the attack of certain corrosive chemical process streams. In particular, it has been found that the alloys of the invention are effective materials of construction for process equipment exposed to process fluids such as those encountered in the manufacture of phosphoric acid, and in the recovery of sour gas and oil from off-shore wells. These alloys have further been demonstrated to be effective in resisting corrosion by both pure and impure sulfuric acid solutions over a wide range of concentrations.

The alloys, in part because of their higher chromium content, resist the corrosive attack of many chemical agents not successfully resisted by prior lower chromium commerical alloys.

Resistance to crevice corrosion and to corrosion under stagnant or low flow conditions are particular advantages of the alloys of the invention when used in seawater or other high chloride solutions. Thus, mud, fouling substances, paint and similar materials do not induce corrosion when imperfectly coated on alloys of the invention exposed to a seawater environment. Additionally, the alloys are non-magnetic and useful for surface and submarine vessel hull construction.

The alloys of the invention are air-meltable and air-castable and possess advantageous mechanical properties which render them suitable as materials of construction for tanks, tubes, pipes, plates, pressure vessels, pumps, agitators, valves, tube sheets and supports for heat exchangers, and cleats, stanchions, pulleys, and deck fittings for oceangoing vessels, off-shore oil and gas rigs, docks and deep "sour" gas and oil drilling and pumping equipment. More particularly, the alloys of the invention are ductile, and thus may be wrought into forms suitable for the above applications.

Unlike the nickel-base alloys which have been used for such service, the alloys of the present invention can be formulated from ferro-alloys, scraps and commercial melting alloys, sources which may contain impurities or contaminants not permitted in nickel-base alloys.

The chromium levels of the alloys of this invention have been recognized for many years to have great advantage in many types of service over those alloys of the 15 to 21% Cr levels. The alloys of the present invention have been so formulated as to take advantage of this and yet at the same time maintain resistance to chloride depassivation.

The nickel levels in the alloys of this invention are such as to maintain a single phase, austenitic (face-centered-cubic) crystal structure in conjunction with the manganese and nitrogen contents. Other prior art alloys have often employed considerably lower nickel levels to the detriment of corrosion resistance in many substances. On the other hand the very high nickel levels of the nickel-base alloys have not been found necessary for most corrosion situations.

Manganese is also a weak austenite stabilizer and is so employed in the alloys of the present invention. However, Mn is also beneficial in increasing resistance to chloride depassivation.

Nitrogen is similar to Mn in the alloys of the present invention. The main difference is that nitrogen, on a weight percent basis, is very much more effective as an austenite stabilizer and in increasing chloride resistance than is Mn. However, nitrogen is a gas in its natural state and must not exceed the maximum of about 0.45% in these alloys if porosity is to be avoided in production. Fontana, U.S. Pat. No. 2,214,128, claims 1% to 4% Mn in iron-nickel-chromium molybdenum-copper alloys. Fontana states that Mn, when added in the proportions as set forth, adds to the alloy the quality of ease of fabrication and does not detract from the corrosion resistance of the alloy. In fact, Fontana illustrates only one example of his invention, namely about 26.7% Ni, 19.7% Cr, 3.4% Mo, 2.0% Cu, and 2.080% Mn. The alloys of the present invention are believed to be effective in part due to higher Cr, Mo and Mn levels than Fontana's one example. The Mn level in Fontana's single example was not high enough to present any of the advantages of Mn in the 3 to 4% range. The level of Mn in the present invention is sufficiently high to aid in chloride resistance, to help stabilize a single-phase austenitic metallic structure and to increase solubility of nitrogen in the solid metallic alloy.

Copper broadens the useful range of chemical solutions to which the alloy is resistant, and enhances the resistance of these alloys to particular solutions without the detriment to chloride resistance often reported by other workers in the field.

Silicon is limited to a maximum of about 1.5% by weight in alloys of this invention so as not to damage their fabricability or weldability. Except for this factor higher Si levels would normally be tolerated in most solutions. Because Mn is such a strong deoxidizer, the very low Si levels that may be allowed in alloys of this invention are of no consequence in maintaining cleanliness and soundness of castings and ingots, although Si is intentionally added in many low Mn alloys for the purpose of deoxidation.

Cerium, lanthanum, misch metal, or some combination of rare earth elements may be arbitrarily added in amounts less than 1% for the purpose of improving workability of ingots of these alloys according to the principles set forth by Post, et. al., U.S. Pat. No. 2,553,330.

Vanadium also enhances the resistance of these alloys to chlorides and acts as a grain refiner. It has been found to be of benefit in amounts up to 1% in alloys of this invention and may be so added without detriment to chemical resistance.

Cobalt may be partially substituted for Ni up to 5% Co without detriment and is sometimes found in Ni-containing ores. Cobalt may thus be regarded in the same manner as Ni in these quantities.

Columbium (niobium) is also employed in alloys of this invention to help resist general chemical attack and as a carbide stabilizer against intergranular corrosion. It has been found to beneficially enhance corrosion resistance of alloys of this invention in amounts up to about 2%.

Combinations of Cr and Mo within the range of proportions of the invention contribute significantly to the resistance of those alloys against attack by seawater. Moreover, where the combination of Cr and Mo satisfies the preferred relationship $$[Mo] \geqq \frac{31}{[Cr] - 12} + 2$$

where

[Mo]=weight % molybdenum and

[Cr]=weight % chromium.

it has been found that the alloys of the invention are especially resistant to $Cl^-$ stress corrosion cracking, as well as $Cl^-$ pitting. A plot of this algorithm is set forth in the drawing. Alloys having a combination of Cr and Mo falling above and/or to the right of the curve have been found to exhibit effective resistance to stress corrosion cracking.

Tantalum sometimes occurs in ores along with columbium and may be present in alloys of the invention without detriment up to about ⅓ of the columbium content.

Carbon has been tested in alloys of the invention to 0.11% without intergranular corrosion if the other element contents are adjusted. Normally, however, it is desirable to maintain carbon levels below about 0.08%.

The essential components of the invention are:

| | |
|---|---|
| Nickel | 13.5–29% by weight |
| Chromium | 23–26% |
| Molybdenum | 3.75–6% |
| Copper | 3.0–6.39% |
| Manganese | 2.95–4.5% |
| Columbium | 0.3–2.07% |
| Nitrogen | 0.10–0.45% |
| Iron | 28–48% |

Cobalt may be present in a proportion of up to about 5% by weight as a partial substitute for Nickel. In any case, the sum of the cobalt and nickel contents should range between about 18.5% and about 29% by weight.

Normally, the alloys of the invention will also contain carbon, up to a maximum of about 0.08% by weight.

Optionally, the alloys of the invention may further contain:

| | |
|---|---|
| Silicon | Up to 1.5% |
| | Titanium Up to 1% |
| Vanadium | Up to 1% |
| Tantalum | Up to 1% |
| Cerium, Lanthanum or Misch Metal | Up to 0.3% |

While many chemical conditions may be well served by alloys containing nickel at the lowest levels of this invention, there are other conditions, including some ranges of sulfuric acid concentration, in which the nickel contents of alloys of the invention should exceed the corresponding chromium contents by at least about 0.5% but not more than about 6% (basis, the entire alloy).

Also, certain conditions are better met with copper contents toward the low side of the above specified ranges. Hence, in many corrosion situations, it has been found preferable to restrict the proportions of the component elements to the following ranges:

| | |
|---|---|
| Nickel | 24–29% |
| Chromium | 23–26% |
| Molybdenum | 3.75–6% |
| Copper | 3–4.5% |
| Manganese | 2.95–4.5% |
| Columbium | 0.3–2.07% |
| Nitrogen | 0.10–0.45% |
| Silicon | 0.10–0.50% |
| Carbon | 0.05% Maximum |
| Nickel minus Chromium | 0.5–6% (basis, the entire alloy) |

While columbium enhances resistance to some corrosive streams, its most effective range in alloys of the invention lies between about 0.3 and about 1.5% by weight. Also, the most effective range of nitrogen in alloys of the invention is between about 0.10 and about 0.25%. For even better resistance to the widest range of corrosive conditions the components of the alloys of this invention should be even further restricted to the following ranges of proportions:

| | |
|---|---|
| Nickel | 25–29% |
| Chromium | 23–26% |
| Molybdenum | 4–6% |
| Copper | 3–4.5% |
| Manganese | 2.95–4.5% |
| Columbium | 0.3–1.5% |
| Nitrogen | 0.10–0.25% |
| Nickel minus Chromium | 2–5% (basis, the entire alloy) |

In an especially preferred embodiment of the invention the nickel content of the alloy exceeds the chromium content by about 3 to about 5% with other components in the following ranges of proportions:

| | |
|---|---|
| Nickel | 26–29% |
| Chromium | 23–26% |
| Molybdenum | 4.5–5.5% |
| Copper | 3–4% |
| Manganese | 3–4% |
| Columbium | 0.5–1.0% |
| Nitrogen | 0.15–0.25% |
| Carbon | 0.01–0.04% |
| Silicon | 0.10–0.40% |
| Nickel minus Chromium | 3–5% (basis, the entire alloy) |

A particularly advantageous alloy having optimum properties in various services combined with optimum mechanical properties has the following composition:

| | |
|---|---|
| Nickel | 27% |
| Chromium | 23% |
| Molybdenum | 5% |
| Copper | 3% |
| Manganese | 3.5% |
| Columbium | 0.8% |
| Nitrogen | 0.20% |
| Silicon | 0.30% |
| Carbon | 0.03% |
| Iron | 35% |

The following examples illustrate the invention.

EXAMPLE 1

One hundred pound heats of several different alloys were prepared in accordance with the invention. Each of the heats was air-melted in a 100-pound high frequency induction furnace. The composition of these alloys is set forth in Table I with the balance in each instance being essentially iron.

TABLE I

| PERCENT BY WEIGHT OF ALLOYING ELEMENTS | | | | | | | | | | |
|---|---|---|---|---|---|---|---|---|---|---|
| ALLOY NO. | Ni | Cr | Mo | Cu | Mn | Si | C | Cb | N | OTHERS |
| 1411 | 21.52 | 23.44 | 5.27 | 3.07 | 3.42 | .29 | .02 | .31 | .21 | 41.2 Fe |
| 2215 | 25.43 | 24.87 | 4.30 | 3.50 | 3.74 | .25 | .04 | .43 | .18 | |
| 2216 | 26.34 | 25.87 | 3.93 | 3.50 | 2.95 | .29 | .05 | .40 | .43 | |
| 2224 | 25.38 | 25.02 | 3.88 | 6.39 | 3.26 | .57 | .05 | .61 | .34 | |
| 2234 | 27.20 | 23.07 | 3.77 | 3.11 | 3.64 | .58 | .05 | 1.95 | .27 | |
| 2235 | 27.65 | 23.95 | 5.62 | 3.23 | 4.26 | .48 | .08 | 2.07 | .31 | |
| 2331 | 25.37 | 23.88 | 5.05 | 3.16 | 3.50 | .28 | .03 | .81 | .20 | .26 V |
| 2226 | 28.59 | 23.02 | 4.73 | 3.50 | 3.83 | .44 | .05 | 1.58 | .12 | |

Standard physical test blocks and corrosion test bars were prepared from each heat. Using the as-cast non-heat-treated physical test blocks, the mechanical properties of each of these alloys were then measured. The results of these measurements are set forth in Table II.

TABLE II

| PHYSICAL PROPERTIES OF ALLOYS AS CAST | | | | |
|---|---|---|---|---|
| ALLOY NUMBER | TENSILE STRENGTH P.S.I. | YIELD STRENGTH P.S.I. | TENSILE ELONGATION % | BRINELL HARDNESS NUMBER |
| 1411 | 53,000 | 30,800 | 16.2 | 153 |
| 2215 | 74,700 | 46,800 | 22 | 181 |
| 2216 | 63,300 | 36,600 | 19 | 160 |
| 2224 | 70,600 | 44,900 | 21 | 173 |
| 2234 | 55,300 | 31,800 | 12.5 | 137 |
| 2235 | 57,500 | 37,900 | 7.5 | 170 |
| 2331 | 75,400 | 47,600 | 20 | 179 |
| 2226 | 53,200 | 31,500 | 16.5 | 137 |

Without heat treatment, the corrosion test bars were machined into 1½ inch diameter by ¼ inch thick discs, each having a ⅛ inch diameter hole in the center.

These discs we used in the comparative corrosion tests, described hereinafter, comparing the performance of the alloys of the invention with a number of alloys which either conform to the prior art or which are similar to the alloys of this invention but do not satisfy certain of the critical composition limitations of the alloys of the invention. The compositions of the comparative alloys used in the tests are set forth in Table III.

TABLE III

| PERCENTAGE BY WEIGHT OF ALLOYING ELEMENTS | | | | | | | | | |
|---|---|---|---|---|---|---|---|---|---|
| ALLOY NUMBER | Ni | Cr | Mo | Cu | Mn | Si | C | Cb | OTHERS |
| 2396 | 18.73 | 18.30 | 6.39 | 1.16 | 3.78 | .32 | .03 | — | .15 N |
| 254SMO | 18.86 | 20.86 | 6.15 | .81 | .51 | .24 | .01 | — | .20 N |
| VEWA963 | 16.15 | 17.01 | 6.31 | 1.57 | .77 | .58 | .02 | — | .19 N |
| IN862 | 24.22 | 21.12 | 5.08 | — | — | — | .02 | — | — |
| 1399 | 19.02 | 17.69 | 7.86 | .68 | 3.84 | .31 | .01 | — | .11 N |
| 1405 | 19.41 | 18.67 | 6.80 | 1.40 | 3.62 | .14 | .01 | — | .11 N |
| 1406 | 15.07 | 14.64 | 18.34 | 1.41 | 3.19 | .26 | .02 | — | .14 N |
| 1407 | 15.27 | 17.24 | 6.90 | 1.70 | 3.35 | .25 | .01 | — | .19 N |
| 1398 | 19.75 | 17.93 | 7.49 | .87 | 3.36 | .26 | .01 | — | .18 N |
| AL6X | 24.20 | 20.12 | 6.24 | — | .66 | .55 | .02 | — | — |
| 316 | 13.11 | 17.92 | 2.46 | — | .89 | .66 | .03 | — | — |

Test discs from alloys of this invention along with those from the various comparative alloys were placed in about 1½" depth of salt solution in plastic containers fitted with virtually airtight lids. The solution consisted of 4 ounces of ordinary, uniodized table salt per gallon of ordinary St. Louis, Mo. city tap water. Twenty-five samples were in each container. They were not touching each other or any other metal—only the bottom of the container.

The liquid from each container was siphoned off once every seven days and replaced by freshly prepared salt solution. The top surfaces of all discs were examined for the appearance of pits or rust spots, which first appeared as reddish-colored spots.

After 160 days of exposure at ambient temperatures the discs were then washed and dried and examined at a magnification of 20× for evidence of pitting or local corrosion on the top surfaces as well as on the bottom surfaces, which had remained in close, stagnant contact with the surface of the plastic containers for the 160 days.

The first appearance of rust spots were as follows:

254SMO—79 days, VEWA963—55 days, IN862—48 days, 1406—84 days, 1407—55 days, Type 316 Stainless Steel—3 hours. No rust spots had appeared on the top or bottom surfaces of any of the alloys of this invention or upon 1399, 1405 or 2396.

EXAMPLE 2

A test similar to that of Example 1 was run on test discs from all of the above alloys of Example 1. In the test of this example, the plastic containers were filled with 4 ounces of salt per gallon of distilled water plus ¼% nitric acid. The pH, or acidity, of this solution was measured at 2.0. It has been shown by many workers in the field of sea water corrosion that decreasing the pH, i.e., increasing hydrogen ion concentration and activity, of a chloride solution causes that solution to more readily depassivate stainless steels and similar alloys. Alloys with resistance to lower values of depassivation pH exhibit better resist crevice corrosion or pitting under stagnant conditions.

In this test, the samples were removed, washed, dried and examined at a magnification of 20× after 60 days exposure. The alloys of this invention were found to have no visible pits or penetration, although alloys 2215, 2216, and 2224 showed small areas of very faint rainbowcolored stains.

All of the other samples not of this invention displayed various amounts of local attack in the form of small black spots of deep penetration on the bottom faces and various sized areas of clear metallic color on the top and bottom faces of the discs. These areas appear as a relatively shallow attack that selectively etches the crystalline dendritic pattern.

EXAMPLE 3

Test discs of alloys of this invention were suspended by platinum wires in 10%, 25%, 40% and 97% sulfuric acid-water solutions at 80° C. (176° F.). Test discs of comparative alloys were also tested in these solutions. The test discs were measured to the nearest 10,000th of a gram before and after exposure and the weight loss expressed in inches per year, $R_{ipy}$, in accordance with this relationship:

$$R_{ipy} = 0.3937 \frac{Wo - Wf}{ATD}$$

$R_{ipy}$=Corrosion rate in inches per year
$W_o$=Original weight of sample
$W_f$=Final weight of sample
A=Area of sample in square centimeters
T=Duration of test in years
D=Density of alloy in grams per cubic centimeter The tests were run for a total of six days exposure. The results are set forth in Table IV.

TABLE IV

CORROSION RATE IN INCHES OF PENETRATION PER YEAR (I.P.Y.) AT 80° C. IN VARIOUS SULFURIC ACID-WATER SOLUTIONS

| ALLOY NUMBER | 10% BY WEIGHT $H_2SO_4$ | 25% BY WEIGHT $H_2SO_4$ | 40% BY WEIGHT $H_2SO_4$ | 97% BY WEIGHT $H_2SO_4$ |
|---|---|---|---|---|
| 1411 | 0.0003 | 0.0006 | 0.0850 | 0.0197 |
| 2215 | 0.0018 | 0.0026 | 0.0275 | 0.0083 |
| 2216 | 0.0041 | 0.0034 | 0.0235 | 0.0054 |
| 2224 | 0.0014 | 0.0030 | 0.0338 | 0.0078 |
| 2226 | 0.0022 | 0.0030 | 0.0135 | 0.0076 |
| 2234 | 0.0010 | 0.0025 | 0.0169 | 0.0054 |
| 2235 | 0.0029 | 0.0000 | 0.0229 | 0.0066 |
| 2331 | 0.0008 | 0.0015 | 0.0000 | 0.0039 |
| 254SMO | 0.0108 | 0.0064 | 0.0751 | 0.0178 |

TABLE IV-continued

CORROSION RATE IN INCHES OF PENETRATION PER YEAR (I.P.Y.) AT 80° C. IN VARIOUS SULFURIC ACID-WATER SOLUTIONS

| ALLOY NUMBER | 10% BY WEIGHT $H_2SO_4$ | 25% BY WEIGHT $H_2SO_4$ | 40% BY WEIGHT $H_2SO_4$ | 97% BY WEIGHT $H_2SO_4$ |
|---|---|---|---|---|
| VEWA963 | 0.0259 | 0.0163 | 0.0667 | 0.0061 |
| IN862 | 0.0022 | 0.0030 | 0.0135 | 0.0075 |
| 2396 | 0.0133 | 0.0029 | 0.0673 | 0.1550 |
| 1399 | 0.0115 | 0.0083 | 0.0383 | 0.0136 |
| 1405 | 0.0191 | 0.0035 | 0.0595 | 0.0212 |
| 1406 | 0.1720 | 0.0168 | 0.0189 | 0.0059 |
| 1407 | 0.0646 | 0.0627 | 0.0688 | 0.0062 |
| 1398 | 0.0073 | 0.0047 | 0.0326 | 0.0056 |
| AL6X | 0.0061 | 0.0092 | 0.0102 | 0.0431 |
| 316 | 0.0131 | 0.0711 | 0.2133 | 0.0071 |

Although there are applications in which higher corrosion rates may be tolerated, about 0.01 I.P.Y. may be considered as a practical maximum for most applications. It is obvious that the alloys of this invention are suitable in the reducing end of the sulfuric acid-water range up to 25% $H_2SO_4$ but generally not suitable to 40% $H_2SO_4$. They also handle the oxidizing 97% $H_2SO_4$ solution. Most of the alloys not of this invention are not usable in the 10 to 25% range and many will not endure the 97% solution.

EXAMPLE 4

Test discs of the invention along with comparative samples of alloys not of this invention were tested for six days at 80° C. (176° F.) in 35% nitric acid-water solution as well as in the same acid concentration to which 4 ounces per gallon of sodium chloride were also added as a chloride depassivator. The results are set forth in Table V.

TABLE V

CORROSION RATE INCHES PF PENETRATION PER YEAR (I.P.Y.) AT 80° C. IN 35% NITRIC ACID-WATER SOLUTION, WITH AND WITHOUT 4 OZ./GAL. SALT ADDITION

| ALLOY NUMBER | 35% BY WEIGHT HNO3 | 35% BY WEIGHT HNO + 4 OZ./GAL. NaCl |
|---|---|---|
| 1411 | 0.0023 | 0.0018 |
| 2215 | 0.0014 | 0.0041 |
| 2216 | 0.0013 | 0.0004 |
| 2226 | 0.0000 | 0.0006 |
| 2234 | 0.0027 | 0.0004 |
| 2235 | 0.0036 | 0.0016 |
| 2331 | 0.0007 | 0.0013 |
| 254SMO | 0.0015 | 0.0027 |
| VEWA963 | 0.0020 | 0.0111 |
| IN862 | 0.0000 | 0.0004 |
| 2396 | 0.0000 | 0.0047 |
| 1399 | 0.0036 | 0.0127 |
| 1405 | 0.0014 | 0.0210 |
| 1406 | 0.0063 | 0.1052 |
| 1407 | 0.0020 | 0.0113 |
| 1398 | 0.0011 | 0.0078 |

From this test it may be seen that even the low-chromium alloys readily passivate in the very highly oxidizing hot 35% nitric acid solution. However, among the comparative alloys even those of high-molybdenum contents do not always maintain passivity in the same acid which also contains the chloride contamination. On the other hand, the alloys of this invention were not depassivated by the chloride additions to the nitric acid.

EXAMPLE 5

Test discs of alloys of the invention along with comparative samples of other aloys were then tested for six days at 80° C. (176° F.) in 86% phosphoric acid to which had been added 4 ounces per gallon of ordinary table salt. The results are set forth in Table VI.

TABLE VI

| CORROSION RATE AT 80° C. IN 86% $H_3PO_4$ PLUS 4 OZ. PER GALLON OF NaCl | |
|---|---|
| ALLOY NUMBER | LOSS IN INCHES OF PENETRATION PER YEAR (I.P.Y.) |
| 1411 | 0.0028 |
| 2215 | 0.0034 |
| 2216 | 0.0036 |
| 2226 | 0.0092 |
| 2234 | 0.0014 |
| 2235 | 0.0022 |
| 2331 | 0.0016 |
| 254SMO | 0.0244 |
| VEWA963 | 0.0507 |
| IN862 | 0.0095 |
| 2396 | 0.0080 |
| 1399 | 0.0182 |
| 1405 | 0.0253 |
| 1406 | 0.0243 |
| 1407 | 0.0509 |
| 1398 | 0.0098 |

This example is one of a moderately aggressive reducing condition plus depassivating chloride contamination.

The alloys of this invention serve very well here, while the lower chromium prior art alloys are either borderline or unsuitable.

Alloys of this invention also resist moderately aggressive oxidizing agents, such as 97% $H_2SO_4$ much better than most prior art sea water alloys. They share excellent resistance with the prior art alloys to very aggressive oxidizing agents such as hot 35% $HNO_3$, with or without chloride contamination. All of the alloys of this invention as well as prior art alloys showed less than 0.001 I.P.Y. attack in 70% nitric acid at 80° C. Results were similar in tests in 15% $HNO_3$ plus 15% $H_2SO_4$-water solutions.

TABLE VII

| CORROSION RATE IN 25% $H_2SO_4$ PLUS 10% $HNO_3$ PLUS 4 OUNCES/GAL. NaCl AT 80° C. | |
|---|---|
| ALLOY NUMBER | LOSS IN INCHES OF PENETRATION PER YEAR (I.P.Y.) |
| 1411 | 0.0007 |
| 2215 | 0.0030 |
| 2216 | 0.0006 |
| 2226 | 0.0030 |
| 2234 | 0.0029 |
| 2235 | 0.0039 |
| 2331 | 0.0008 |

In view of the above it will be seen that the alloys of this invention not only resist the depassivating attack of salt water but also resist a wide variety of corrosive streams, some of them containing chloride contamination in themselves. They present a broaden spectrum of corrosion resistance, particularly in moderately aggressive reducing or oxidizing conditions.

What is claimed is:

1. An air meltable, castable, fabricable, weldable, and non-magnetic alloy resistant to corrosion by chloride or other halide containing solutions, consisting essentially of between about 13.5% and about 29% by weight nickel, between about 23% and about 26% by weight chromium, between about 3.75% and about 6% by weight molybdenum, between about 2.95% and 4.5% by weight manganese, between about 3% and 6.39% by weight copper, between about 0.3% and 2.07% by weight columbium (niobium), between about 0 and about 1.5% by weight silicon, between about 0 and about 0.09% by weight carbon, between about 0.10% and about 0.45% by weight nitrogen, up to about 1% by weight vanadium, up to about 1% by weight titanium, up to about 5% by weight cobalt, up to about 0.3% by weight of rare earth components selected from the group consisting of cerium, lanthanum, and misch metal, and between about 28% and 48% by weight iron, the sum of the nickel content and cobalt content being between about 18.5% and 29% by weight, and the nickel content exceeds the chromium content by between about 0.5% and about 6% by weight (basis, the entire alloy).

2. An alloy as set forth in claim 1 containing between about 24% and 29% by weight nickel, between about 23% and about 26% by weight chromium, between about 3.75% about and 6% by weight molybdenum, between about 3% and about 4.5% by weight copper, between 2.95% and 4.5% by weight manganese, between about 0.3% and about 2.07% by weight columbium, between about 0.10% and about 0.45% by weight nitrogen, between 0.10% and about 0.50% by weight silicon, and up to about 0.05% by weight carbon, the nickel content exceeding the chromium content by between about 0.5% and about 6% by weight (basis, the entire alloy).

3. An alloy as set forth in claim 1 containing between about 25% and about 29% by weight nickel, between 23% and about 26% by weight chromium, between about 4% and about 6% by weight molybdenum, between about 3% and about 4.5% by weight copper, between about 2.95% and about 4.5% by weight manganese, between 0.3% and about 1.5% by weight columbium, and between about 0.10% and about 0.25% by weight nitrogen, the nickel content exceeding the chromium content by between 2% and about 5% by weight (basis, the entire alloy).

4. An alloy as set forth in claim 1 containing between about 26% and about 29% by weight nickel, between 23% and about 26% by weight chromium, between about 4.5% and about 5.5% by weight molybdenum, between about 3% and about 4% by weight copper, between about 3% and about 4% by weight manganese, between 0.5 and about 1.0% by weight columbium, between 0.15% and about 0.25% by weight nitrogen, between 0.01% and about 0.04% by weight carbon, and between 0.10% and about 0.40% by weight silicon, the nickel content exceeding the chromium content by between 3% and about 5% by weight (basis, the entire alloy).

5. An air meltable, castable, fabricable, weldable, and non-magnetic alloy resistant to corrosion by chloride or other halide containing solutions, comprising approximately 27% by weight nickel, approximately 23% by weight chromium, approximately 5% by weight molybdenum, approximately 3% by weight copper, approximately 3.5% by weight manganese, approximately 0.8% by weight columbium, approximately 0.20% by weight nitrogen, approximately 0.30% by weight silicon, approximately 0.03% by weight carbon, and approximately 35% by weight iron.

* * * * *